US005405030A

United States Patent [19]

Frazier

[11] Patent Number: 5,405,030

[45] Date of Patent: Apr. 11, 1995

[54] DUAL-COMPARTMENT DRINKING CUP

[76] Inventor: Sara J. Frazier, 433 Clover La., Fort Collins, Colo. 80521

[21] Appl. No.: 200,708

[22] Filed: Feb. 23, 1994

[51] Int. Cl.[6] ..... B65D 1/24

[52] U.S. Cl. ..... 215/6; 220/556; 220/505; 220/676; 220/703

[58] Field of Search ..... 215/6; 220/555, 556, 220/505, 703, 772, 676

[56] References Cited

U.S. PATENT DOCUMENTS

| | | | |
|---|---|---|---|
| 66,788 | 7/1867 | Brooks et al. | 220/555 |
| 149,887 | 4/1874 | Sawyer | 220/555 |
| 258,777 | 5/1882 | Leonard | 220/555 |
| 1,275,467 | 8/1918 | Poulalion | 215/6 |
| 1,941,327 | 12/1933 | Turner | 215/6 |
| 2,652,701 | 9/1953 | Longhurst | 215/6 |
| 3,134,523 | 5/1964 | Hostetter | 220/703 |
| 3,261,494 | 7/1966 | Walker, Jr. | 220/555 |
| 3,341,876 | 9/1967 | Campbell | 220/555 |
| 3,633,785 | 1/1972 | Cyr | 220/556 |
| 4,919,295 | 4/1990 | Hitzler | 220/505 |

FOREIGN PATENT DOCUMENTS

| | | | |
|---|---|---|---|
| 782971 | 7/1935 | France | 220/505 |
| 3422441 | 12/1985 | Germany | 220/703 |

*Primary Examiner*—Stephen J. Castellano
*Attorney, Agent, or Firm*—Hugh H. Drake

[57] ABSTRACT

A drinking cup has a generally cylindrical rim portion above an at least semi-cylindrical base portion. A generally semi-cylindrical rear wall is disposed between a segment of the rim portion and the base portion, while an also semi-cylindrical front wall is disposed between the remaining segment of the rim portion and a level significantly above the base portion. A rear floor joins the lower end of the rear wall and the base portion, and an upper floor joins the front wall at the defined level. A vertical generally central divider defines with the rear wall and the rear floor a long rear compartment and also defines with the front wall and the upper floor a short front compartment. A handle is shaped to permit handling by either the right or left hand and may be formed during manufacture as a separate sub-assembly which includes an insert that is received to become a continuation of the front wall below the upper floor. The relative volumes of the front and rear compartments are selected so that upon draining the front compartment the rear compartment retains a volume about half that originally poured into the drinking cup

9 Claims, 8 Drawing Sheets

FIG. 12
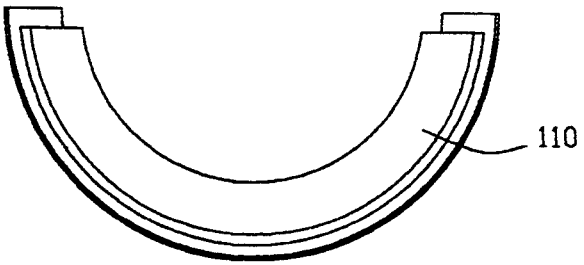
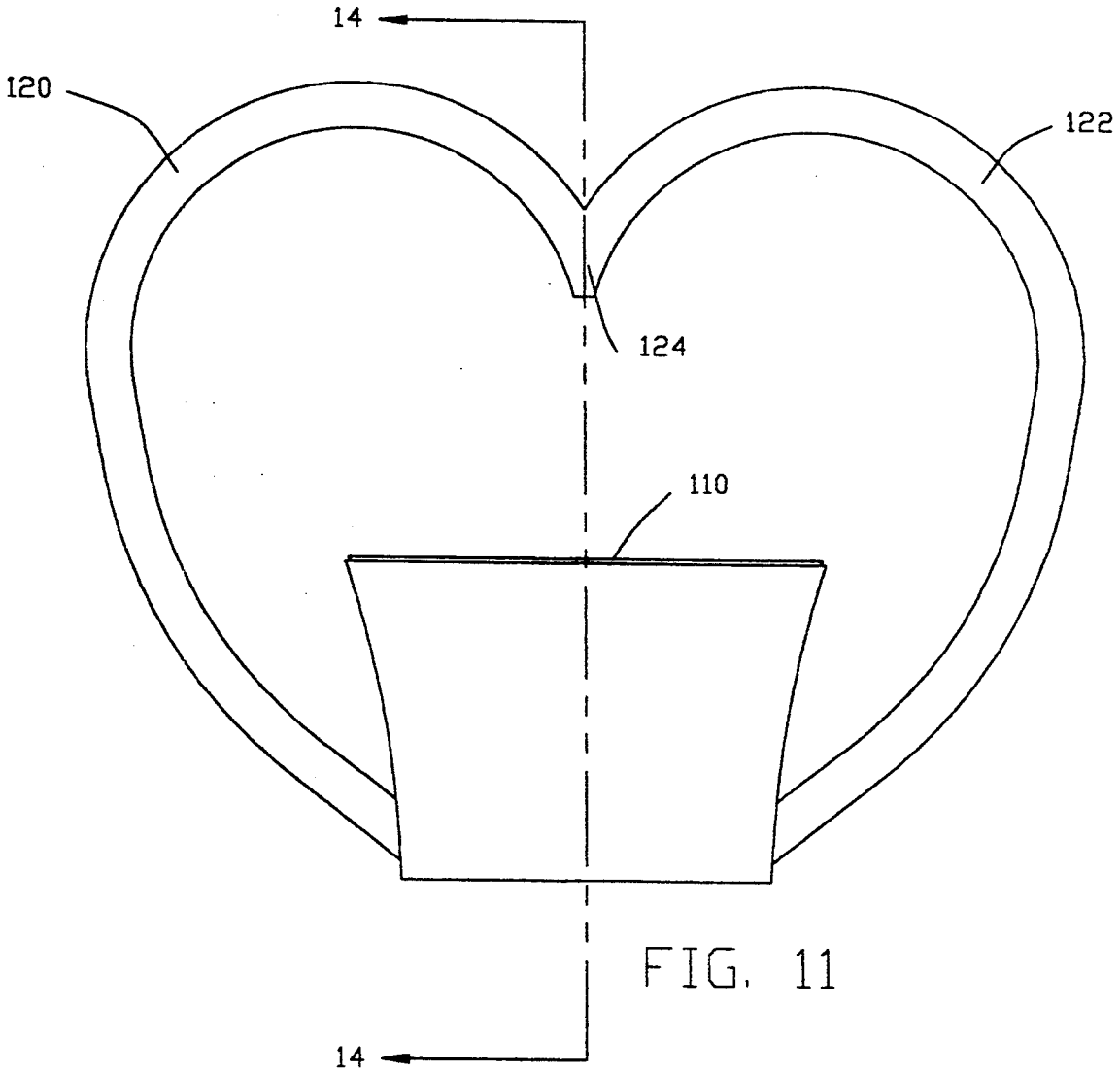
FIG. 11

DUAL-COMPARTMENT DRINKING CUP

The present invention relates to a drinking cup. More particularly, it relates to a drinking cup having a unique configuration which comports with a philosophical message.

Drinking cups are found to vary widely in shape and ornamentation. For use by children the shape may take the form of one of a particular kind of an animal or a part of an animal such as the head. At Christmas time one will see mugs having an external appearance resembling the face of Santa Claus. Sometimes additional features are included by reason of the character or the user. For example, mustache mugs, having a shelf partially across the top to keep the mustache away from the liquid, are now primarily a collector's item. The special purpose of cup of U.S. Pat. No. 4,083,467—Mullins et al includes structural features so that if dropped on the floor the spout stays on the high side to inhibit leakage.

An object of the present invention is to provide a new and improved cup the arrangement of which enables one portion to become partially full as another portion becomes partially empty.

Another object of the present invention is to provide a new and improved mug having features of compartmentalization while yet being at least primarily produced by use of a single mold.

A further object of the present invention is to provide a drinking cup of the same basic general form but enabling easy change of one part to obtain a handle of different form.

In accordance with one aspect of the present invention, a drinking cup includes a generally-cylindrical rim portion and an at least generally semi-cylindrical base portion spaced below that rim portion. A generally semi-cylindrical rear wall is disposed between a rear segment of said rim portion and base portion, while a generally semi-cylindrical front wall is disposed between the remaining front segment of said rim portion and a level significantly above said base portion. A rear floor joins the lower end of the rear wall and the base portion, and an upper floor joins the front wall at the aforementioned level. A vertical generally-central divider defines with the rear wall and the rear floor a long rear compartment and also defines with the front wall and the upper floor a short front compartment.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements and in which:

FIG. 11 is a front elevational view of a handle accessory used with the embodiment of FIGS. 6–10;

FIG. 12 is a top plan view of a central portion of the accessory shown in FIG. 11;

Figure 2:
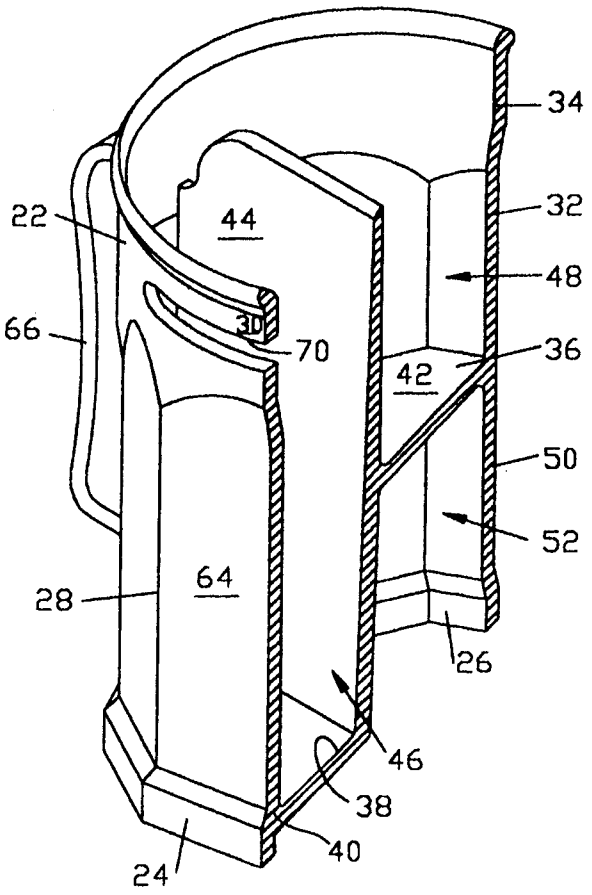
FIG. 2 is a view similar to FIG. 1 but with a vertical cross-section taken along the line 2—2 in FIG. 1.
Figure 1:
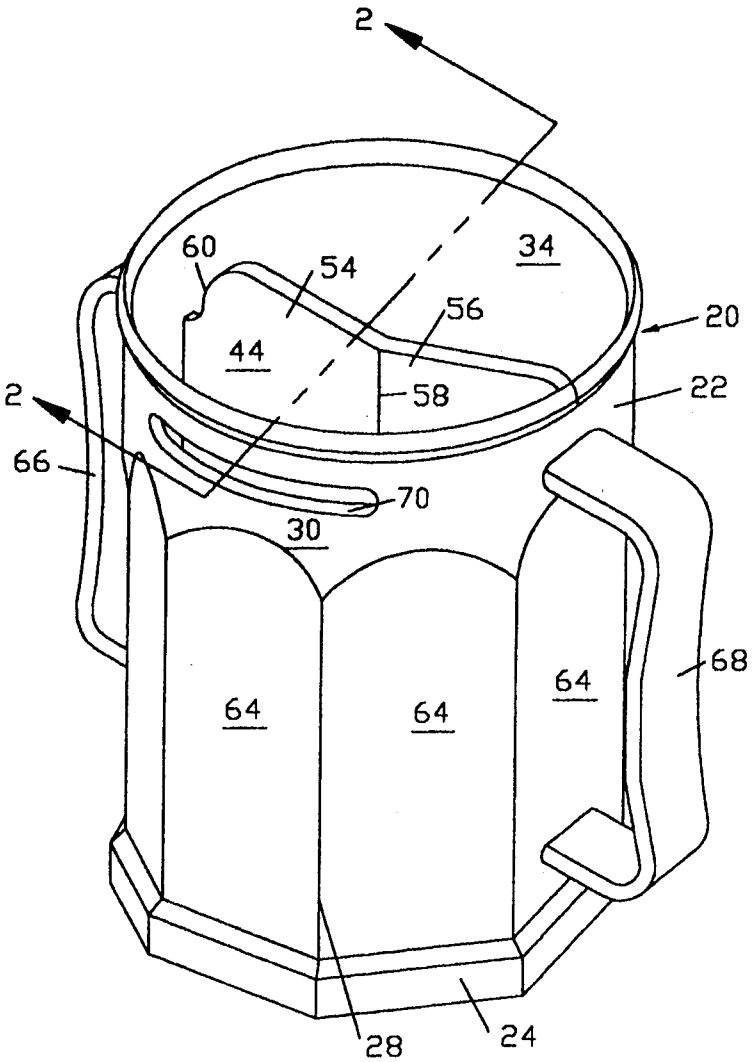
FIG. 1 is an isometric view of a drinking cup embodying a first embodiment of the present invention.
Figure 3:
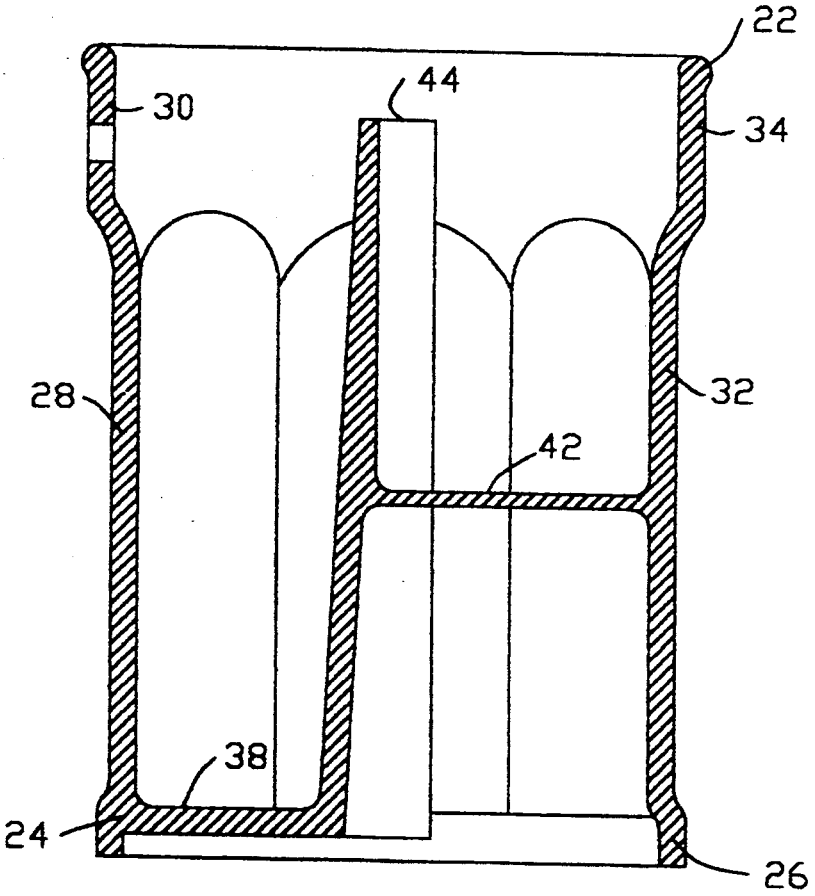
FIG. 3 is a true cross-sectional view taken along the line 2—2 in FIG. 1.
Figure 5:
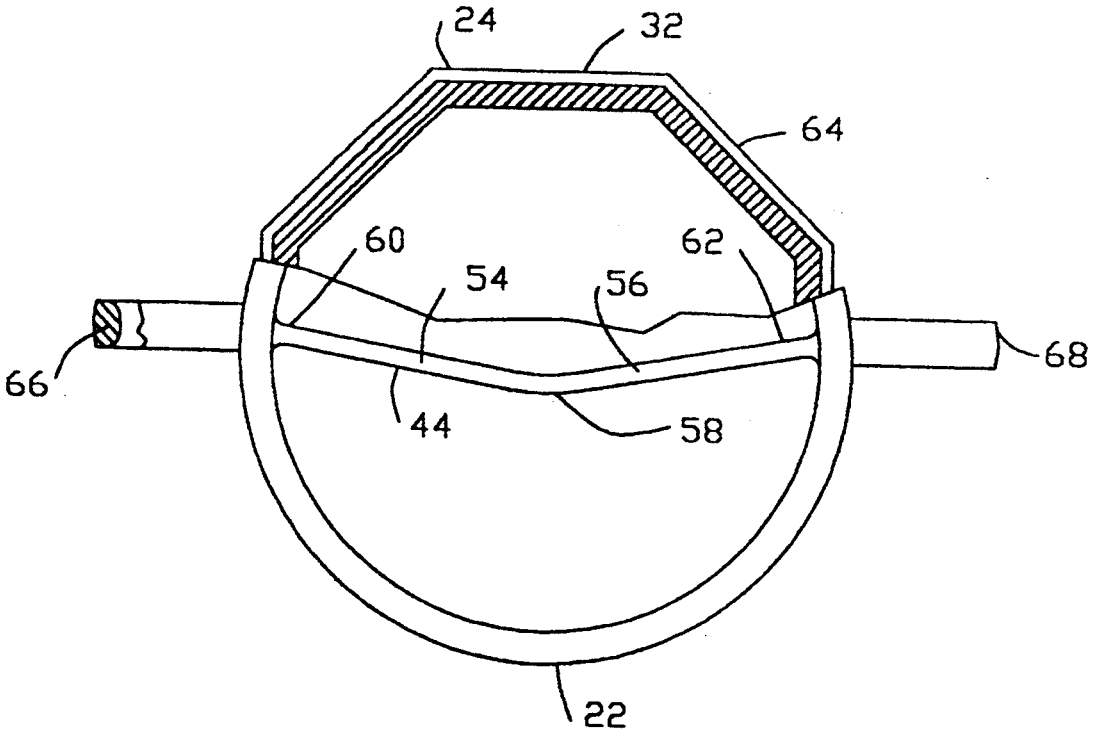
FIG. 5 is a top plan view, partially broken away, of the cup of FIG. 1.
Figure 4:
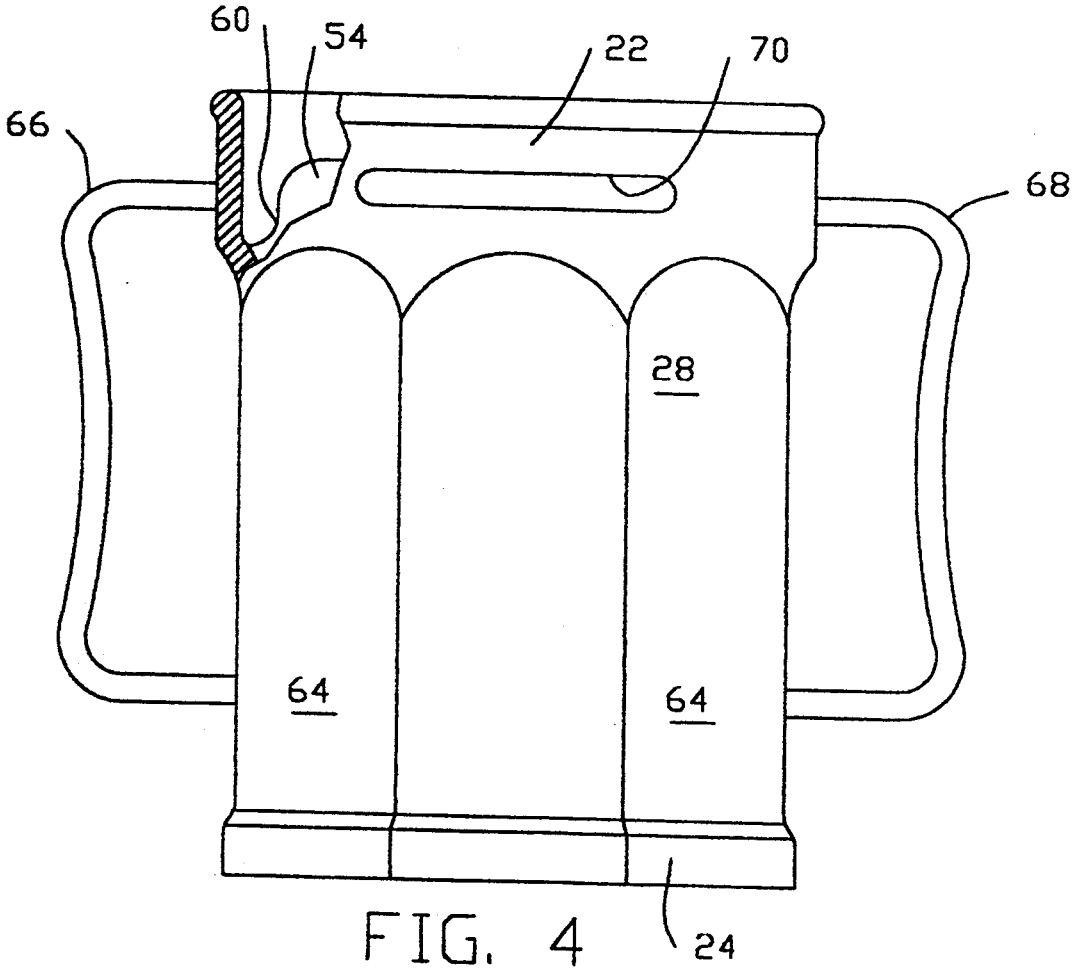
FIG. 4 is a rear elevational view, partially broken away, of the cup of FIG. 1.

A drinking cup 20 has a generally-cylindrical rim portion 22. A generally semi-cylindrical rear base portion 24 is spaced below rim portion 22 and in this case further includes another generally semi-cylindrical front base portion 26 which completes a total base portion that is generally cylindrical and here in particular is octagonal. A generally-cylindrical rear wall 28 is disposed between a rear segment 30 of rim portion 22 and base portion 24. An also generally-cylindrical front wall 32 is disposed between a remaining front segment 34 of rim portion 22 and a level at a surface 36 located significantly above base portion 24 and its continuation 26. A rear floor 38 at its outer circumference joins the lower end 40 of rear wall 28 at base portion 24. Joining front wall 32 at level 36 is an upper floor 42.

A vertical generally central divider 44 defines with rear wall 28 and rear floor 38 a long rear compartment 46. Divider 44 also defines with front wall 32 and upper floor 42 a short front compartment 48. In this particular embodiment, a continuation 50 of front wall 32 continues from upper floor 42 downwardly into joinder with the additional base portion 26 so as to define still another compartment 52 open over its bottom.

Divider 44 is composed of a pair of integrally-joined laterally spaced panels 54 and 56 joined at an angle forming apex 58 which faces toward the rear. Formed in divider 44 at each end thereof adjacent the inner wall of rim portion 22 are respective ones of a pair of notches 60 and 62. Notches 60 and 62 each have a depth as to end at about the level of the bottom of rim portion 22. The purpose of angling divider 48 into its two parts 54 and 56 is to inhibit spillage across the top of the divider at a high tilt angle.

As ornamentation and also to permit grasping of front and rear walls 38 and 22 between the thumb and fingers, the external circumference of the combination of the front and rear walls are shaped to define a series of facets 64. However, the cup preferably is held in one or two hands by means of a pair of handles 66 and 68 respectively projecting from opposite sides of cup 20. The provision of two handles rather than just one is to better accommodate both right and left-handed people.

Formed through segment portion 30 above rear wall 28 and above the bottoms of notches 60 and 62 is an opening 70. It is intended that the user drink from the front of the cup and more specifically out of the top of rim segment 34. Opening 30 serves to let the user know by lip contact that he and she is not drinking from the preferred side. For use of the cup in accordance with the full practice and demonstration of a principle, rear compartment 46 is first filled with a liquid to be consumed by the user. As the user tilts the cup forwardly, tipping rim segment 34 outwardly, liquid flows through notches 60 and 62 and into compartment 48 after which or during which operation the liquid may be drank from compartment 48. Compartments 46 and 48 and the depth of notches 60 and 62 are such that after draining the maximum amount normally possible from compartment 48 the cup although now half empty is also still half full by reason of the amount of liquid remaining in compartment 46. The relative sizes of the front and rear compartments are selected to permit the drinking of a given amount of liquid from said front compartment to result in leaving a similar amount of liquid remaining in said rear compartment.

Figure 6:
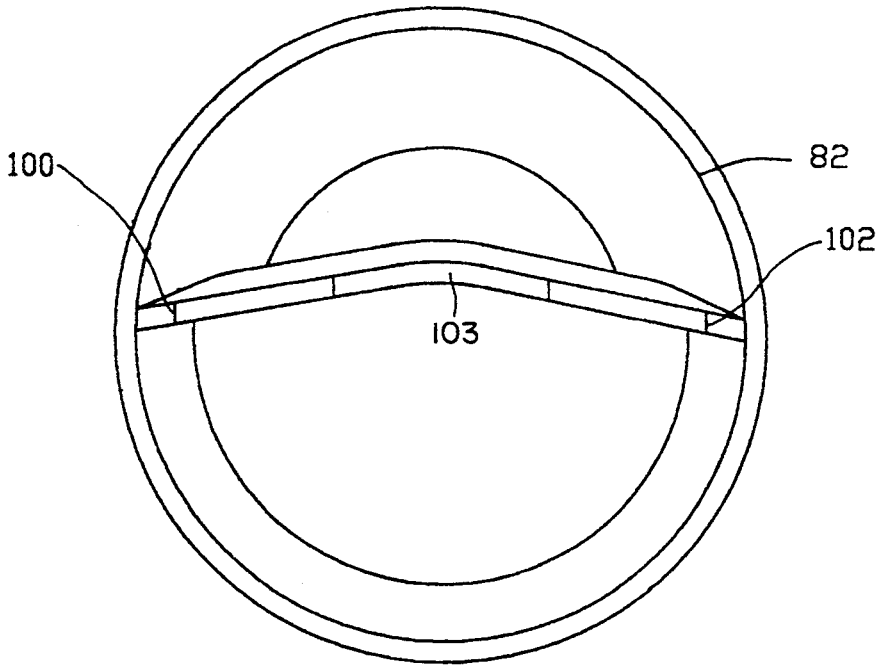
FIG. 6 is a top plan view of a second embodiment of a drinking cup.
Figure 7:
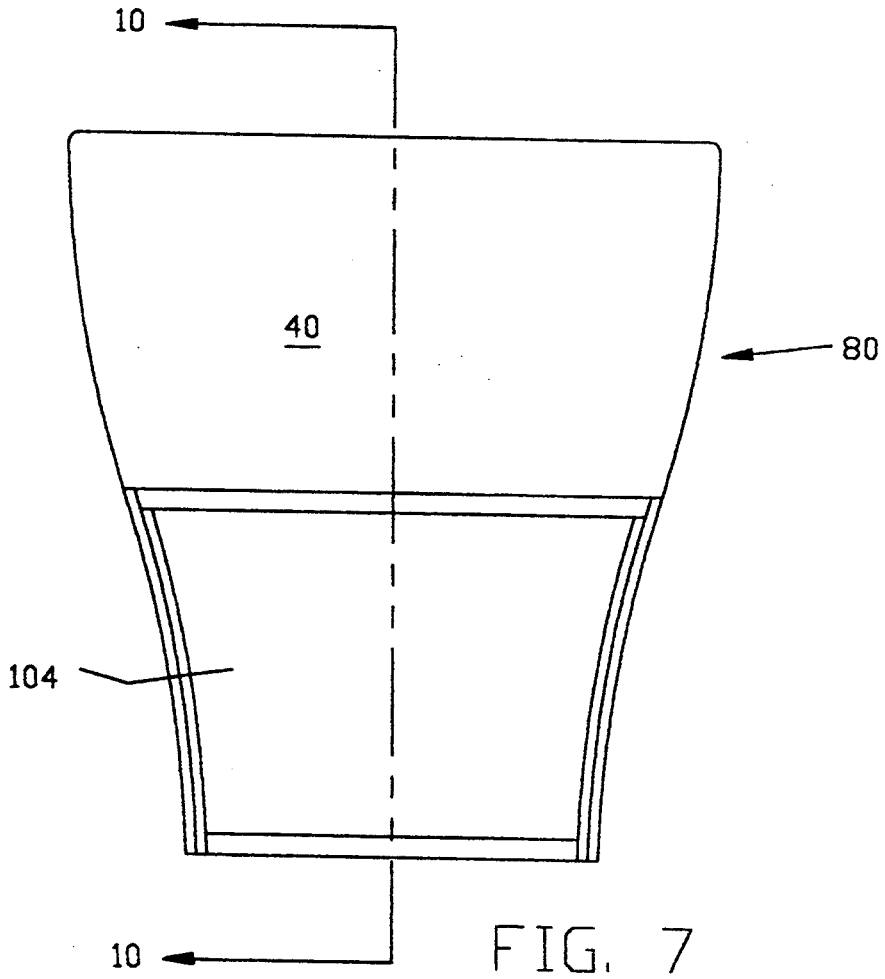
FIG. 7 is a front elevational view thereof.
Figure 8:
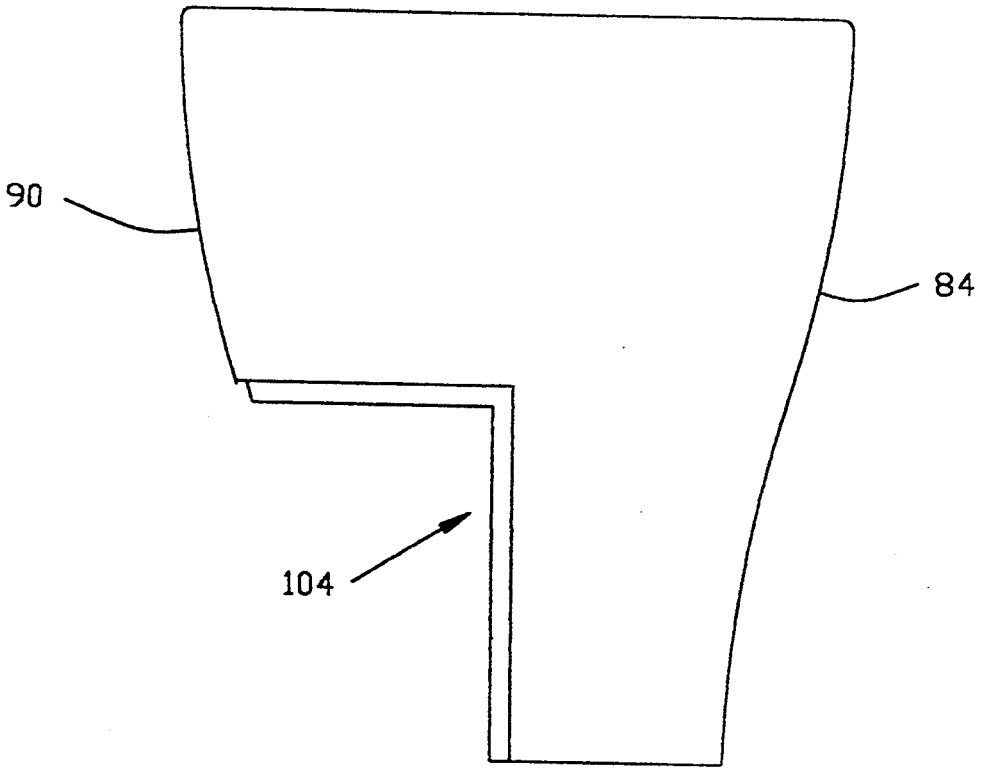
FIG. 8 is a side elevational view thereof.
Figure 10:
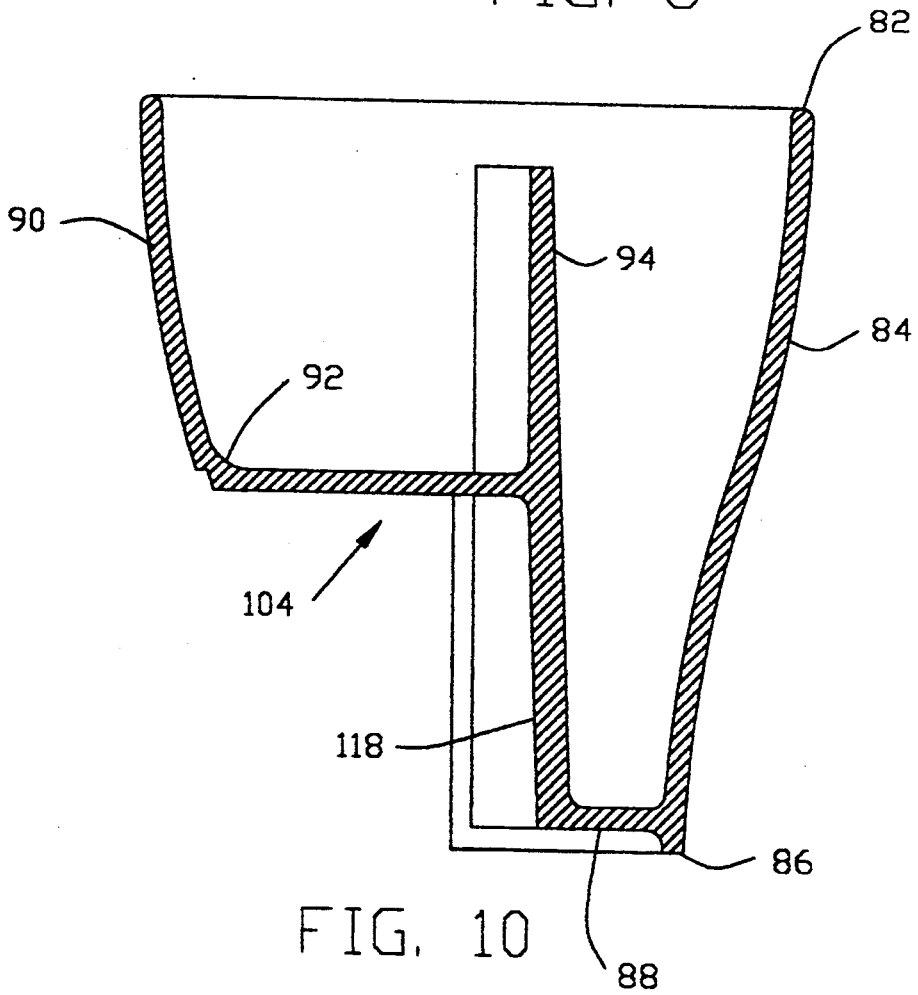
FIG. 10 is a vertical cross-sectional view taken along the line 10—10 in FIG. 7.
Figure 9:
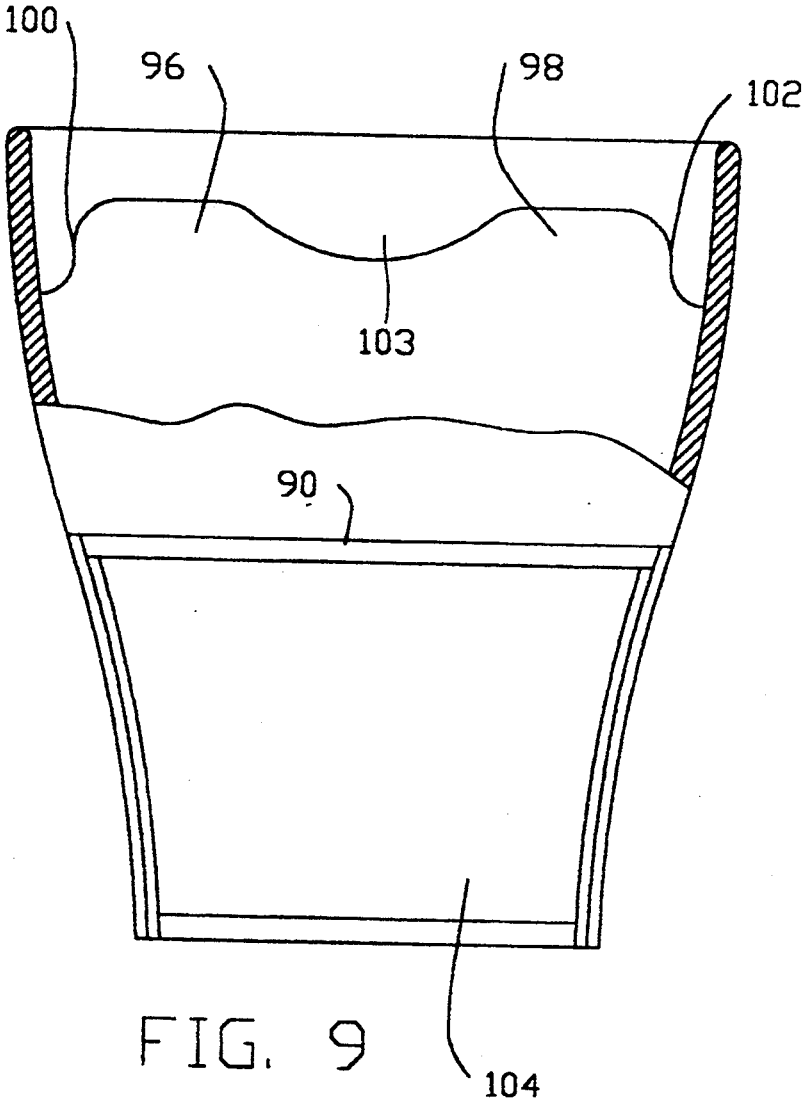
FIG. 9 is a view similar to FIG. 7 but partially broken away.
Figure 15:
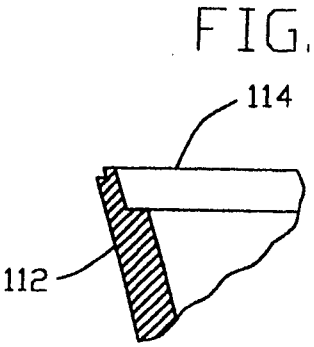
FIG. 15 is a fragmentary view, partially in cross-section, of a detail circled at 15 in FIG. 14.
Figure 16:
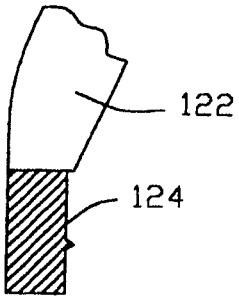
FIG. 16 is a fragmentary view, partially in cross-section, a detail circled at 16 in FIG. 14.
Figure 14:
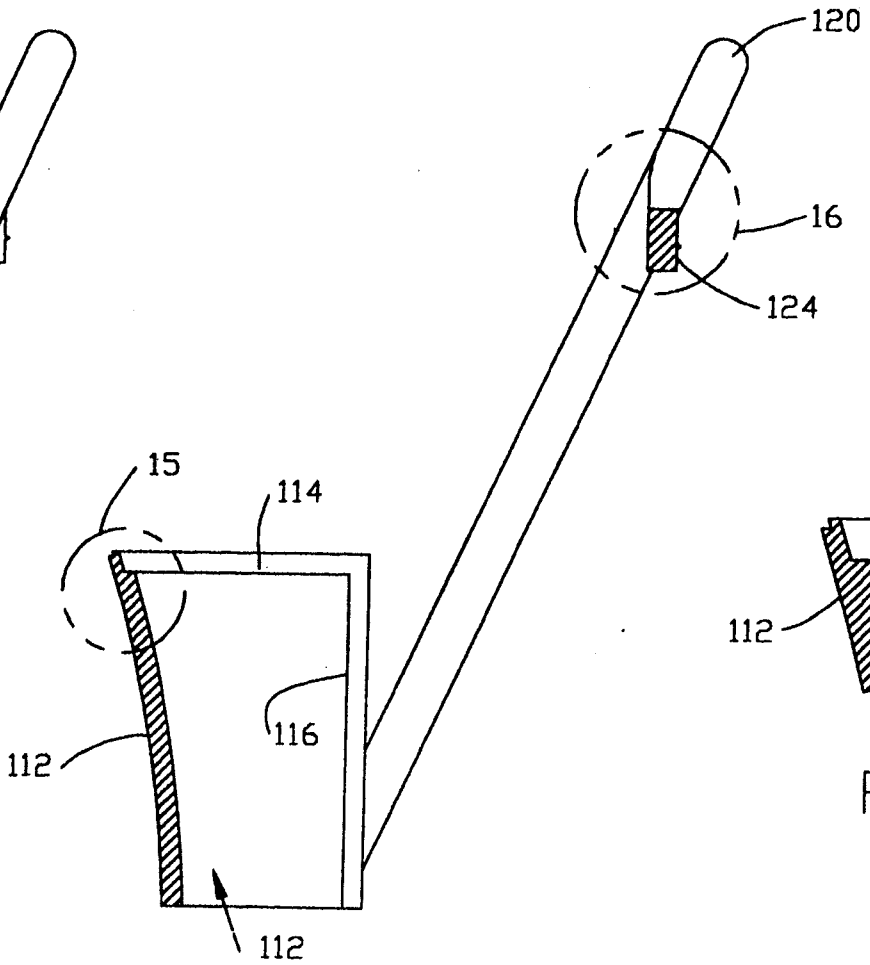
FIG. 14 is a cross-sectional view taken along the line 14—14 in FIG. 11.
Figure 13:
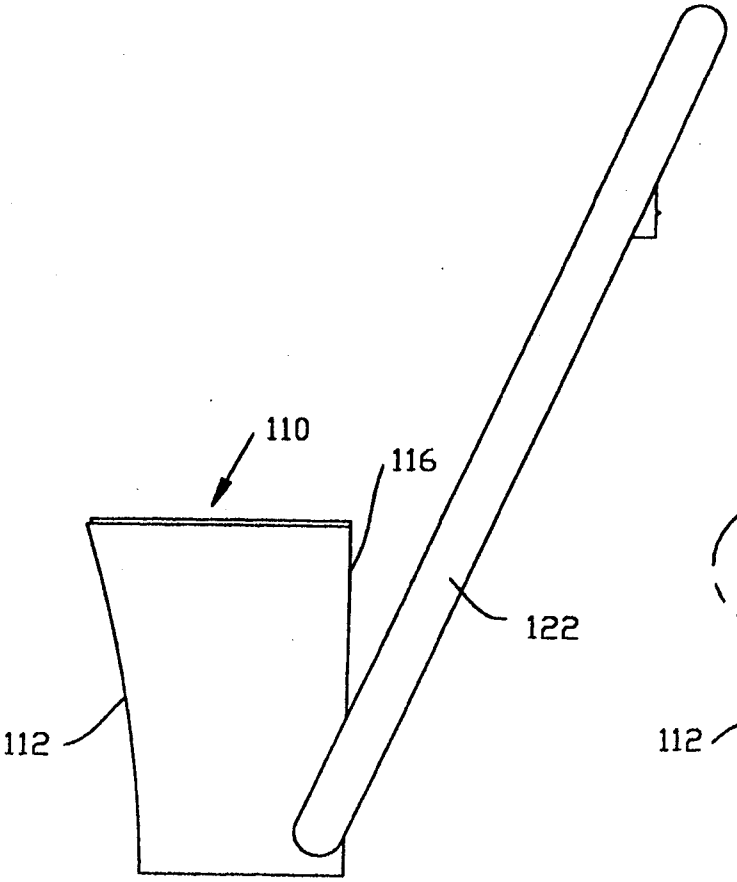
FIG. 13 is a side elevational view of the accessory of FIG. 11.

In a second embodiment depicted in FIGS. 6–16 the same demonstration of principle is involved. A cup 80 has a rim 82 from which downwardly depends a rear wall 84 terminating in a rear base portion 86 and having a rear floor 88. A front wall 90 is joined to an upper floor 92. There again is a vertical generally-central divider 94 having mutually-angled panels 96 and 98 at respective ends of which are notches 100 and 102. A depression 103 is formed into the upper adjoining portions of divider panels 96 and 98. In this case, however, there is no downward continuation of the front wall to complete definition of a lower front compartment. Instead, the cup as initially molded or otherwise fabricated includes a recess 104 in the lower front portion of the article.

To be bonded as by cementing or ultrasonic welding into place within recess 104 is an insert 110. Insert 110 includes what becomes a lower front wall 112 of matching exterior conformation and a horizontal wall 114 which mounts beneath upper floor 92 and a vertical wall 116 that mounts against the lower portion 118 of divider 94.

Any of a variety of handle shapes may be employed. As illustrated, the handle is of an overall heart shape having horizontally spaced loops 120 and 122 joined midway by a bar 124. Each lower end of the respective ones of loops 120 and 122 are joined integrally to wall 116.

As in the case of the first-described embodiment, the drinking cup of the second embodiment may be employed to demonstrate, teach or remind of the relationship in life as between a cup that is half empty and yet half full. Quite differently, however, the drinking cup of either embodiment may be used in connection with the in situ mixing of two different liquids that are to be ingested simultaneously. Such on-site mixing may be employed to add a pleasant tasting liquid to a foul-tasting medicine in an effort to mask the bad taste. Additional compartmentalization by means of further vertical division is also possible in accordance with the same principle in order to obtain in situ mixing of more than two liquids at the same time. Analogously, such mixing during the process of the pouring of two or more liquids of still different kinds may similarly be implemented for other purposes.

While particular embodiments of the invention have been shown and described, it will be obvious to those skilled in the art that changes and modifications may be made without departing from the invention in its broadest aspects. Therefore, the aim in the appended claims is to cover all such changes and modifications as fall within the true spirit and scope of that which is patentable.

I claim:

1. A drinking cup comprising:

a generally cylindrical rim portion;

an at least generally semi-cylindrical base portion spaced below said rim portion;

a generally semi-cylindrical rear wall connected between a rear segment of said rim portion and said base portion;

a generally semi-cylindrical front wall connected between a remaining front segment of said rim portion and a level significantly above said base portion;

a rear floor connected at its outer circumference to the lower end of said rear wall at said base portion;

an upper floor joining said front wall at said level;

and a vertical generally-central divider defining with said rear wall and said rear floor a long rear compartment and defining with said front wall and said upper floor a short front compartment and said divider being connected to said front and rear walls, wherein said divider has an upper edge portion in which a notch is formed at a location adjacent to said front and rear walls.

2. A drinking cup as defined in claim 1 in which another notch is formed at the other side of said vertical divider.

3. A drinking cup as defined in claim 1 in which an upper edge of said divider is spaced below the top of said rim portion a predetermined distance.

4. A drinking cup as defined in claim 1 in which said vertical wall is composed of a laterally-adjacent pair of panels joined together at an angle to define an apex facing said rear wall.

5. A drinking cup as defined in claim 1 in which an opening is defined through said rim portion above said rear wall.

6. A drinking cup as defined in claim 1 which includes a pair of outwardly-projecting handles individually disposed along laterally-opposite sides of said drinking cup respectively between said front and rear walls.

7. A drinking cup as defined in claim 1 in which the relative sizes of said front and rear compartments are selected to permit the drinking of a given amount of liquid from said front compartment to result in leaving a similar amount of liquid remaining in said rear compartment.

8. A drinking cup as defined in claim 1 which further includes a lower semi-cylindrical similar forward wall portion continuing from said level to said base portion.

9. A drinking cup as defined in claim 1 in which said divider includes an upper edge portion shaped to define a notch at each side adjacent to a junction between said front and rear walls and further includes a depression located centrally in said upper edge portion.

* * * * *